US008469096B2

(12) United States Patent
McGarian

(10) Patent No.: US 8,469,096 B2
(45) Date of Patent: Jun. 25, 2013

(54) WHIPSTOCK

(76) Inventor: Bruce McGarian, Stonehaven (GB)

( * ) Notice: Subject to any disclaimer, the term of this patent is extended or adjusted under 35 U.S.C. 154(b) by 734 days.

(21) Appl. No.: 12/300,778

(22) PCT Filed: May 15, 2007

(86) PCT No.: PCT/GB2007/001788

§ 371 (c)(1),
(2), (4) Date: Feb. 5, 2009

(87) PCT Pub. No.: WO2007/132232

PCT Pub. Date: Nov. 22, 2007

(65) Prior Publication Data

US 2010/0012322 A1 Jan. 21, 2010

(30) Foreign Application Priority Data

May 16, 2006 (GB) ..... 0609696.0

(51) Int. Cl.
*E21B 7/08* (2006.01)

(52) U.S. Cl.
USPC ..... 166/298; 166/55.6; 166/117.5

(58) Field of Classification Search
USPC ..... 166/297, 298, 55.6, 117.5, 255.3
See application file for complete search history.

(56) References Cited

U.S. PATENT DOCUMENTS

| | | | | |
|---|---|---|---|---|
| 4,397,355 | A | 8/1983 | McLamore | |
| 5,109,924 | A | 5/1992 | Jurgens | |
| 5,445,222 | A | 8/1995 | Pritchard | |
| 5,551,509 | A * | 9/1996 | Braddick | 166/55.7 |
| 5,771,972 | A | 6/1998 | Dewey | |
| 5,826,651 | A | 10/1998 | Lee | |
| 5,894,889 | A | 4/1999 | Dewey | |
| RE36,526 | E | 1/2000 | Braddick | |
| 6,102,123 | A | 8/2000 | Bailey | |
| 6,302,198 | B1 * | 10/2001 | Ritorto et al. | 166/55.1 |
| 6,499,538 | B2 * | 12/2002 | Dewey et al. | 166/297 |
| 2004/0089443 | A1 | 5/2004 | Dewey | |
| 2006/0249310 | A1 | 11/2006 | Stowe | |
| 2009/0133877 | A1 * | 5/2009 | Neff | 166/298 |

FOREIGN PATENT DOCUMENTS

| | | |
|---|---|---|
| EP | 1222357 | 4/2004 |
| EP | 2018463 | 1/2009 |

(Continued)

OTHER PUBLICATIONS

EPO Examination Report in corresponding EP Application 07732812.8; May 13, 2009; 3 pages.

(Continued)

*Primary Examiner* — Jennifer H Gay
(74) *Attorney, Agent, or Firm* — Hancock Hughey LLP

(57) ABSTRACT

A whipstock with a longitudinal axis includes a tapered face surface, at least a part of which is inclined with respect to the longitudinal axis, for guiding a milling head as the milling head passes from a top end to a bottom end of the face surface. A deflecting arrangement protrudes from the face surface and has first and second deflection surfaces. At least a part of each of the deflection surfaces is raised above the face surface, and each of the first and second deflection surfaces are inclined at a greater angle with respect to the longitudinal axis than the face surface in the region of the deflection arrangement. The first deflection surface is located closer to the top end of the face surface than the second deflection surface.

20 Claims, 14 Drawing Sheets

FOREIGN PATENT DOCUMENTS

| | | | |
|---|---|---|---|
| GB | 2315506 | | 2/1998 |
| GB | 2348898 | | 10/2000 |
| GB | 2348660 | B | 11/2000 |
| GB | 2420359 | | 5/2006 |
| WO | 97/10409 | | 3/1997 |

OTHER PUBLICATIONS

Applicant's Letter of Reply to EPO Examination Report in corresponding EP Application 07732812.8; Jun. 29, 2009; 3 pages.

* cited by examiner

WHIPSTOCK

DESCRIPTION OF INVENTION

THIS INVENTION relates to a whipstock and to an associated single trip whipstock system, and more particularly to a system that can be run into the well bore as an assembly and oriented, set and operated to mill a window in the casing of the well bore to enable a sidetrack or lateral in the surrounding formation in a single trip. The system may also be used complimentary to a multi lateral operation and completion of the well bore thereof.

In the drilling of oil wells it is sometimes necessary to form a branch extending off an existing bore, maintaining where possible as much of the original integrity of the casing for completion tieback purposes. These branches are known as laterals or sidetracks dependent upon the future application of the exit and whether communication is required with the original bore (mother bore). These branches are generally formed through insertion of a tapered deflecting device—whipstock—into the existing bore, which is used to deflect a milling tool or assembly radially outward from the well bore axis. The milling assembly traverses the length of the whipstock making a cut into the casing in the well bore at the top of the whipstock, and elongating it as it travels along the whipstock face. As the milling assembly reaches the lower end of the whipstock, it becomes more exposed to the formation until it departs the original well bore milling or drilling into the surrounding formation. The milling assembly can reasonably be expected to drill a short length of formation, or an extended length subject to the dressing and dressing characteristics applied to the milling tools. Once this formation has been drilled the milling assembly is recovered from the well bore in readiness for drilling applications.

It is well known that early whipstock systems necessitated several trips in hole, from providing a means to set an anchor or packer in the hole, establishing the orientation of the anchor or packer, and then latching a whipstock into the anchoring means with a mill before initiating the cut out through the casing wall. Subsequent mill runs would be required to elongate the window and mill into the formation before the operation would be complete. In more recent years, single trip whipstock systems have evolved, each of them endeavoured to improve the efficiency of the deployment and milling process. All systems require an anchoring means, which may include an isolation method such as a packer, or packer element combined with the anchor, which can be run in conjunction with the whipstock and milling assembly in the hole, and which prevent relative movement between the whipstock and the anchor or packer.

These anchors can also be mechanically or hydraulically set in the well bore, and may be set in conjunction with other barriers which have been preset in the well bore prior to running the whipstock assembly. When setting an anchor mechanically—having first set the barrier, for example a bridge plug, in the well bore for the anchor to be triggered against, it is considered that this makes the whipstock system deployment two trip. In the event, whether this additional barrier is run or not, and the whipstock system set hydraulically, the main features of the whipstock system remain the same, however, in the hydraulic set option, there is usually a means to circulate for orientation purposes with a MWD tool (Measurement While Drilling tool) to the well bore without setting the anchor. This usually means that a bypass valve or ported sub is required, to allow fluid bypass through the drill string. Actuation of the valve is usually determined by flow rate and subsequent pressure drop through a piston, or piston and nozzle combination, which is used to shear pins or cycle the piston in response to switching the flow on and off till the valve closes, allowing a static pressure to build up in the system to set the anchor in the well bore. If a ported sub is used, and this can be in conjunction with a valve, the flow rate is increased dynamically until the pressure drop across the port circulating flow to annulus is high enough to initiate the setting sequence in the anchor. Either way, and with whatever valve means, utilising MWD, and a bypass means, the orientation of the whipstock system can be determined such that it can be adjusted prior to initiating the setting sequence.

The present invention claims to improve the known techniques and methods for creating the window to enable a lateral or sidetrack to be drilled.

In a preferred embodiment of the invention the milling tool is secured at the top of the whipstock by a releasable fastening means such as a shear bolt. Once the orientation has been established and the anchor or packer set, verification of the set can be made through applying an upward or downward load on the drill string, if necessary, establishing circulation, and then sufficient load applied to shear the bolt in either an upward or downward fashion. Some anchors, if mechanically set require that the shear bolt is sheared in a downward manner. Milling can commence once sufficient clearance has been made with the milling tool from the top of the whipstock by picking up on the drill string.

Preferably, the upper end of the whipstock is formed with a tapering angle which may vary according to the requirement for a shallow or steep departure angle from the existing well bore—normally defined as the dog leg severity (DLS) across the whipstock in degrees per hundred feet (°/100 ft). A low DLS requires that the whipstock face angle may be anywhere between 0.5° and 3°, but not limited to this range, and a high DLS require that the whipstock face angle is between 3° and 10°, but not limited to this range. The top of the whipstock is plain and consistent with the face angle above. The whipstock will be provided with a kick out lug, which allows interaction with and support of the milling assembly, as well as allowing the use of a full gauge mill, and prevents inadvertent milling away of the top of the whipstock. The kick out lug can comprise one ramp, and preferably is provided with at least two ramps so that as the milling assembly mills and wears the kick out lug profile away, the remaining critical bearing area, that is ineffective as described below, is replaced with at least a second bearing face to support the milling assembly, and preserve the whipstock face. The kick out lug is fully sacrificial in this respect, and is not fully consumed until the first mill has fully cut through the casing and can then traverse the whipstock face in the normal manner without necessitating a change in the milling assembly. The kick out lug surface is fully compliant with the mill profile and both are described in more detail below.

In previous designs, to minimise initial milling stresses on the milling assembly and top of whipstock, the whipstock top may be profiled to interact with the milling assembly to assist in the radial movement as the mill engages and traverses the whipstock, with resultant wear problems as shown in GB 2348660B which sought to reduce problems as a consequence of the system shown in U.S. Pat. No. 5,771,972. The solution provided by GB 2348660B does not entirely eliminate the wear problems, and subject to milling assembly design and its interaction with the casing and formation, may still result in wear problems, and significantly, both systems above are dependent upon the interaction with the whipstock top directly with the first mill, and when the bearing area of the whipstock top reduces, the whipstock mills away preferentially although this is not desirable. Furthermore, where casing wall thicknesses are thicker than normal, the consequence of the wear is that the mill does not penetrate the casing fully, and then again goes on to preferentially mill the whipstock, and failing to exit into the formation. Compensation for this effect is achieved by providing a substantially thicker whipstock top, to push the mill out through the casing, which increases the stresses on the milling assembly, and yet still fails to eliminate the wear problem. Again, as the bearing area reduces, the whipstock top becomes a sacrificial element.

Alternative milling assemblies have utilised mills with incrementally increasing diameters as they are spaced out up the assembly, to reduce the tendency of milling into the whipstock, and to gradually enlarge the window opening as each of the mills passes through. These assemblies either seek to use a lug similar to the two trip system placed between a first under gauge mill and a second mill, such as in U.S. Pat. No. 5,109,924 and EP 1,222,357 B1, or in the case of U.S. Pat. No. 5,455,222 and U.S. Pat. No. 6,102,123 have no lug at all.

Other solutions utilising blocks in either one or two trip systems have under gauge milling assemblies, where the first mill addressing the formation is directly attached and straddling the whipstock, so by design it must be smaller in diameter than the following mills, or the mill may be full gauge, but is mounted via an extended plain tapered nose, which deflects the mill off the block, the mill can not exit the casing as a consequence of the nose which becomes trapped in the space between whipstock and casing, and so the mill must be exchanged for a second mill (hence the two trip designation). In U.S. Pat. No. 4,397,355 A1, a two trip system is portrayed as a one trip system as the whipstock and anchoring means was delivered and set in the well bore in a single run. The window however would have been milled in at least two milling runs.

Examples of such designs as discussed can be found in the following documents: U.S. Pat. No. 5,109,924, U.S. Pat. No. 5,445,222, U.S. Pat. No. 6,102,123, EP 1,222,357 B1, GB 2310231 A, and U.S. Pat. No. 4,397,355 A1. Furthermore, U.S. Pat. No. 5,826,651 portrays similar milling assemblies which have detachable nose cones or faces which are consumed down hole by milling or explosive means as part of the window milling and exiting process, or left in pockets in the whipstock face to facilitate window milling in one run.

It is an object of the present invention to seek to provide an improved whipstock and associated whipstock assembly. Accordingly, one aspect of the present invention provides a whipstock having a longitudinal axis and comprising: a tapered face surface, at least part of which is inclined with respect to the longitudinal axis, for guiding a milling head as the milling head passes from a top end to a bottom end of the face surface; and a deflecting arrangement protruding from the face surface and having first and second deflection surfaces, at least a part of each of the deflection surfaces being raised above the face surface and each of the first and second deflection surfaces being inclined at a greater angle with respect to the longitudinal axis than the face surface in the region of the deflection arrangement, wherein the first deflection surface is located closer to the top end of the face surface than the second deflection surface.

Advantageously, the deflection arrangement is joined to the face surface.

Alternatively, the deflection arrangement is integral with the face surface.

Conveniently, the first and second deflection surfaces are substantially parallel with each other, with the planes of the surfaces being offset from one another.

Advantageously, each of the deflection surfaces has a top edge, being the edge nearest to the top end of the face surface, and a bottom edge, being the edge nearest to the bottom end of the face surface, and wherein the bottom edge of the first deflection surface is raised above the face surface by a greater amount than the top edge of the second deflection surface.

Preferably, the second deflection surface is provided substantially adjacent the first deflection surface.

Alternatively, a space is provided between the first and second deflection surfaces.

Conveniently, the deflection arrangement is provided as a single unit protruding from the face surface.

Advantageously, the deflection arrangement is provided at or close to the top end of the face surface.

Preferably, at least the first and second deflection surfaces are formed from a material which is harder than that from which the face surface is formed.

Conveniently, the whipstock comprises at least a third deflection surface, wherein: at least a part of the third deflection surface is raised above the face surface; the third deflection surface is inclined at a greater angle with respect to the longitudinal axis than the face surface in the region of the deflection arrangement; and the third deflection surface is located further from the top end of the face surface than the second deflection surface.

Advantageously, the whipstock comprises at least a fourth deflection surface, wherein: at least a part of the fourth deflection surface is raised above the face surface; the fourth deflection surface is inclined at a greater angle with respect to the longitudinal axis than the face surface in the region of the deflection arrangement; and the fourth deflection surface is located further from the top end of the face surface than the third deflection surface.

Another aspect of the present invention provides a whipstock assembly comprising: a whipstock according to any of the above; and a milling arrangement comprising a milling head, at least a part of the profile of the milling head being shaped so that, when the milling head is guided by the face surface of the whipstock during normal use thereof, the part of the profile is substantially parallel with the at least one of the deflection surfaces when the part of the profile meets the at least one of the deflection surfaces.

Preferably, when the milling head is guided by the face surface of the whipstock during normal use thereof, the part of the profile is substantially parallel with the first deflection surface when the part of the profile meets the first deflection surface and is substantially parallel with the second deflection surface when the part of the profile meets the second deflection surface.

A further aspect of the present invention provides a method of guiding a milling head to form a cutout in the casing of a bore, comprising the steps of: providing a whipstock having a longitudinal axis and comprising: a tapered face surface, at least part of which is inclined with respect to the longitudinal axis, for guiding a milling head as the milling head passes from a top end to a bottom end of the face surface; and a deflecting arrangement protruding from the face surface and having first and second deflection surfaces, each of which is inclined at a greater angle with respect to the longitudinal axis than the face surface in the region of the deflection arrangement, wherein the first deflection surface is located closer to the top end of the face surface than the second deflection surface; locating the whipstock in the existing bore so that the top end thereof is uppermost; providing a milling arrangement comprising a milling head, at least a part of the profile of the milling head being shaped so that, when the milling head is guided by the face surface of the whipstock during normal use thereof, the part of the profile is substantially parallel with the at least one of the deflection surfaces when the part of the profile meets the at least one of the deflection surfaces; and driving the milling assembly so that the milling head is guided by the face surface as the milling head passes from a top end to a bottom end of the face surface, and so that the milling head is deflected towards the casing of the existing bore by the first deflection surface and deflected towards the casing of the existing bore again by the second deflection surface.

Another aspect of the present invention provides a whipstock having a longitudinal axis and comprising a tapered face surface, at least part of which is inclined with respect to the longitudinal axis, for guiding a milling head as the milling head passes from a top end to a bottom end of the face surface, wherein the inclination of the face surface with respect to the longitudinal axis is greater at a first region near the top end thereof than at a second region near the bottom end thereof, with the face being curved between the first region and the second region so as to be substantially continuous.

Conveniently, the whipstock face has a transitional portion between the first region and the second region, inclination of the whipstock face with respect to the longitudinal axis changing gradually over substantially the length of the transition portion, the transition portion being at least one-third of the length of the total whipstock face.

Advantageously, the transition portion is at least one-half of the length of the total whipstock face.

Preferably, the transition portion is at least two-thirds of the length of the total whipstock face.

Conveniently, the transition portion is substantially the entire length of the whipstock face.

In order that the present invention may be more readily understood, embodiments thereof will now be described, by way of example, with reference to the accompanying drawings, in which.

Figure 1:
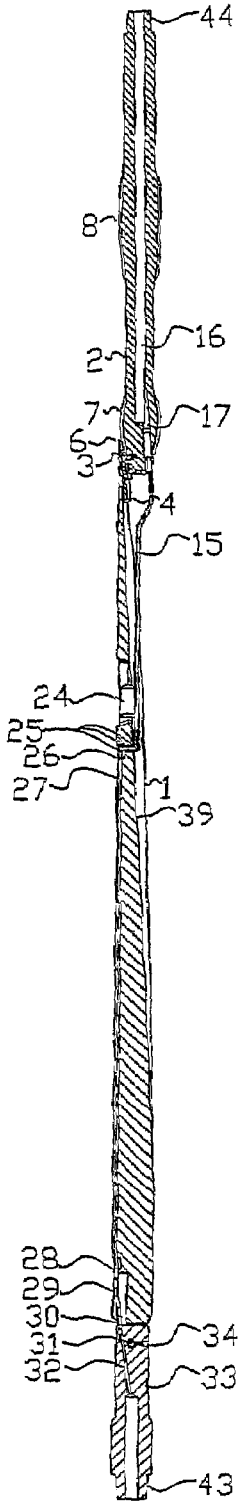
FIG. 1 illustrates an embodiment of the invention, which represents the hydraulic set arrangement for the whipstock assembly, showing a milling assembly, attached to the top of the whipstock assembly but excluding the packer or anchor, with enlarged views FIG. 1*a* of the milling assembly and FIG. 1*b* of the whipstock with hinge connector.
Figure 1A:
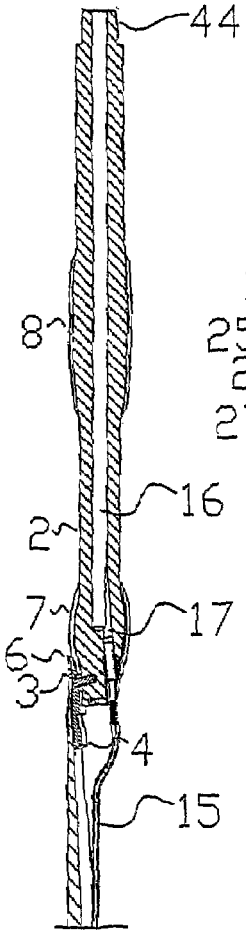
Figure 1B:
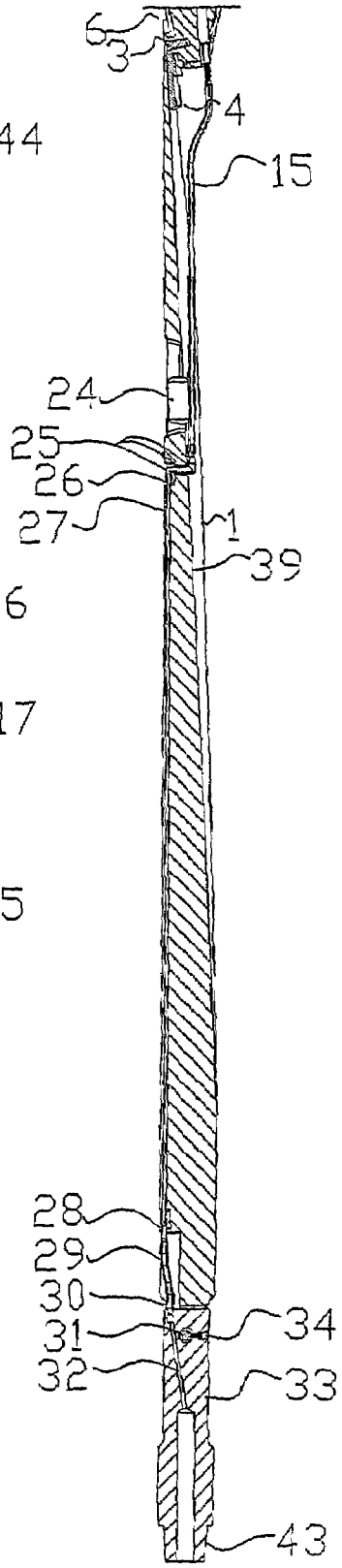

Referring firstly to FIG. 1, the illustrated single trip whipstock assembly comprises a hinge connector 33; attached to a whipstock 1; a whipstock kick out lug 4; a securing means 3; a milling assembly 2 comprising a first mill 7; a second mill 8; whereby the milling assembly 2 is secured to the whipstock kick out lug 4 by a releasable connector 3. The whipstock 1 is connected to a hinge connector 33 by means of a hinge pin 31. The hinge connector 33 is attached to an anchor or packer by means of a threaded connection 43, and the milling assemblies are also attached to each other by means of a threaded connection 44. A hydraulic flow path is provided from the milling assembly to the hinge connector by means of pipes 15, 27, 29 and bores 16, 17, 32 to enable setting of a hydraulically activated packer or anchor assembly.

Figure 2:
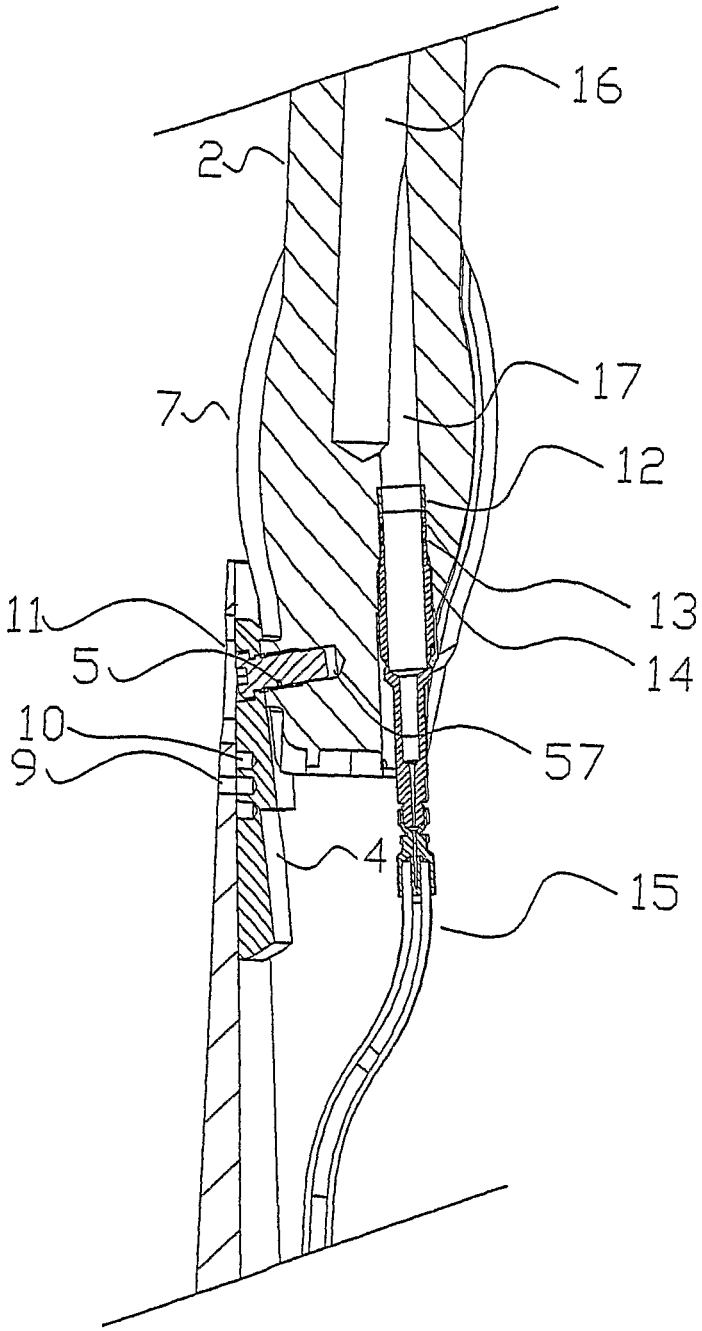
FIG. 2 illustrates the mill attachment to the whipstock kick out lug, and means of locating the lug and attachment of the mill to the whipstock top. Also shown is a hydraulic connection between mill and whipstock.
Figure 3:
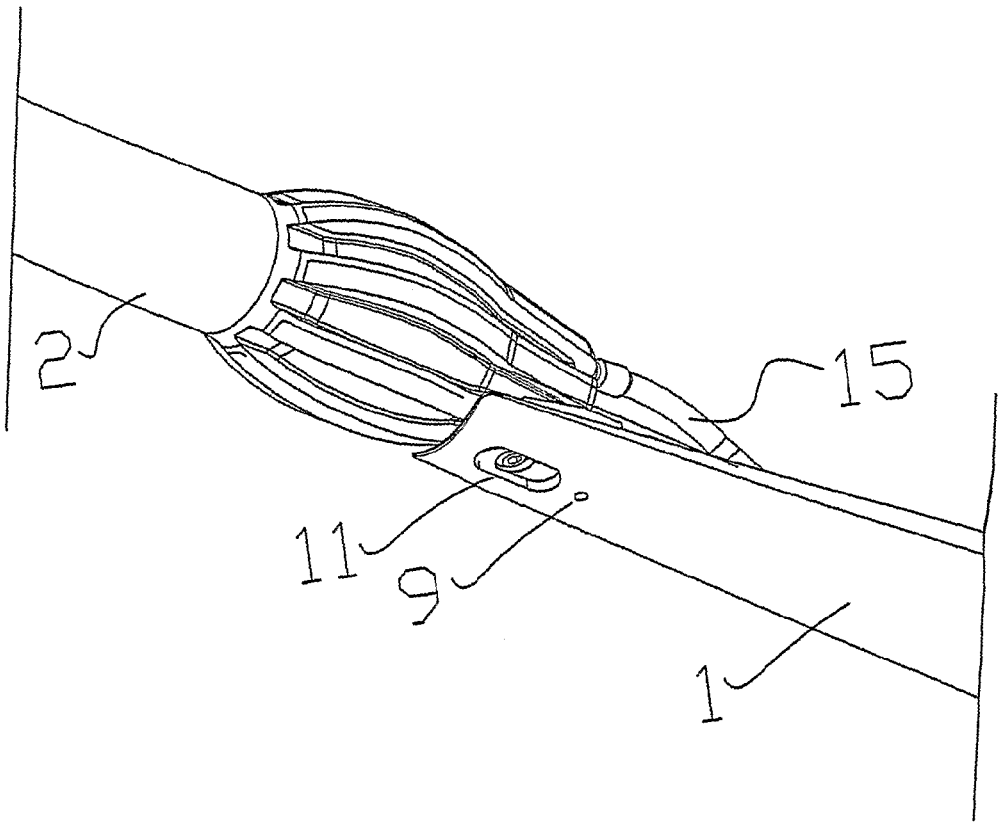
FIG. 3 illustrates the mill head profile and location/alignment holes for the lug and shear bolt from the underside of the whipstock.

The kick out lug 4 and releasable connector 3 are described in more detail hereinafter. In use, the complete assembly is run in to the well on suitable pipe to the required depth, is correctly oriented, using either a UBHO sub or MWD tool located above a bypass valve, and the packer is set. A hydraulic fluid barrier is provided as an isolation means between the well bore fluid and the setting fluid for the anchor or packer. The connection 3 between the mill assembly 2 and the whipstock top 6 via the kick out lug 4 through slot 11, FIGS. 2 and 3, is released to allow the milling of a window in the surrounding casing, to enable the commencement of a rat hole using the first mill 7 for subsequent drilling operations to extend the lateral bore or sidetrack as required. The window which is initiated by the first mill 7 is extended by the second mill 8 and any other mill (not shown) included in the assembly, which is shown in FIG. 10.

Figure 4:
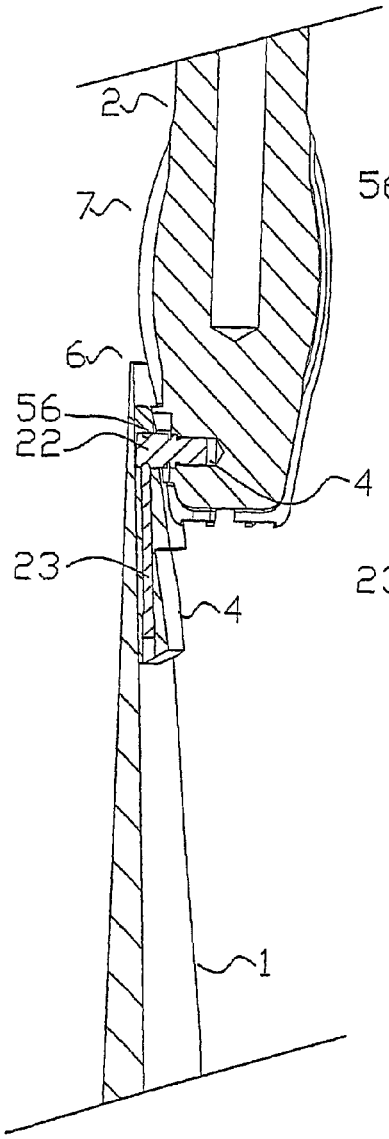
FIG. 4 illustrates an alternative mill attachment to the whipstock kick out lug, with an enlarged view, FIG. 4*a* of the shear bolt.
Figure 4A:
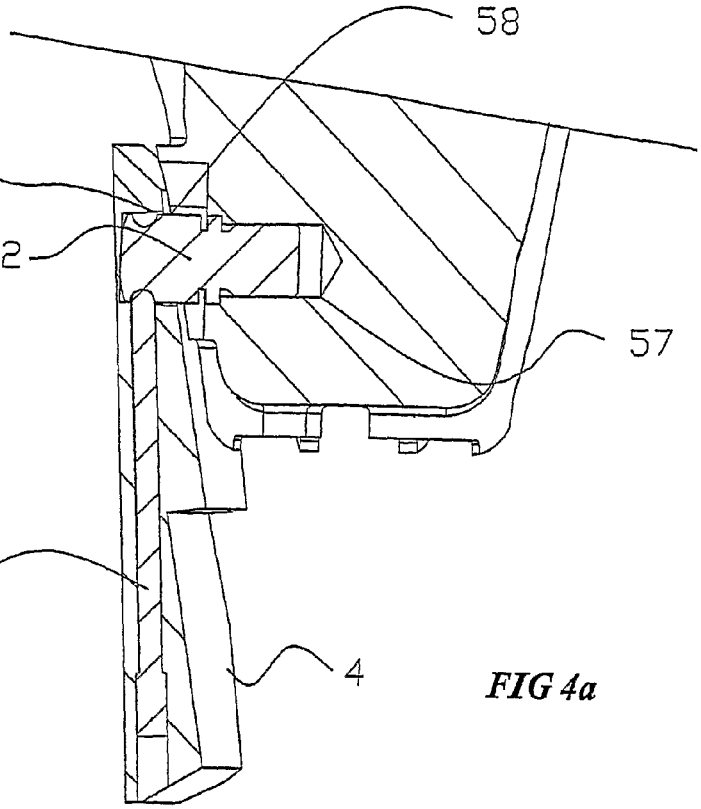
Figure 10:
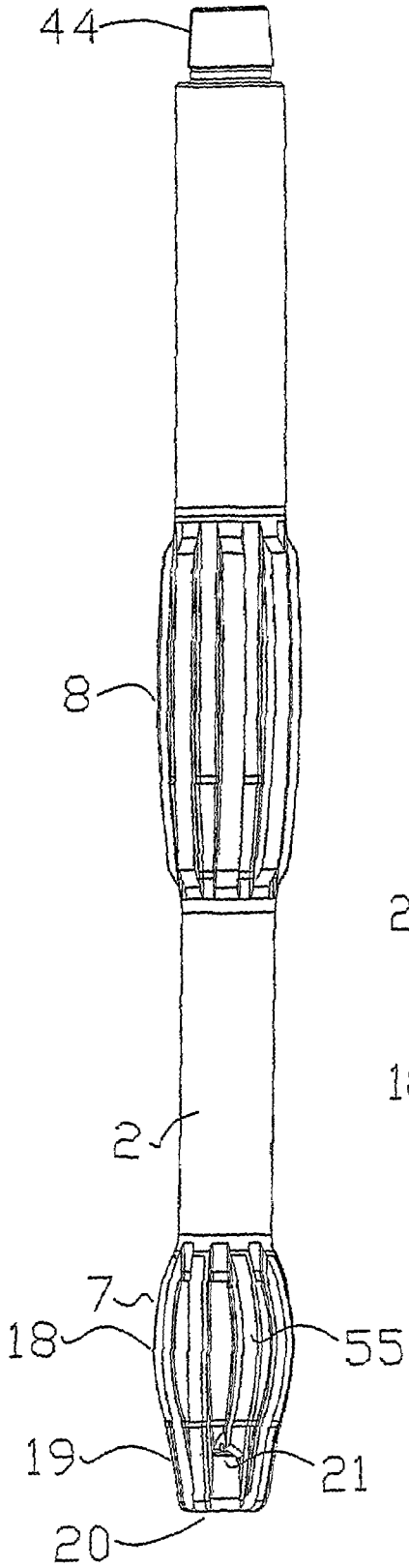
FIG. 10 illustrates the mill configuration.
Figure 10:
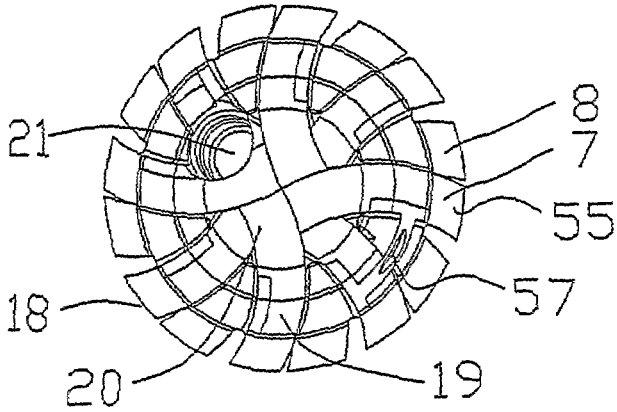
Figure 11:
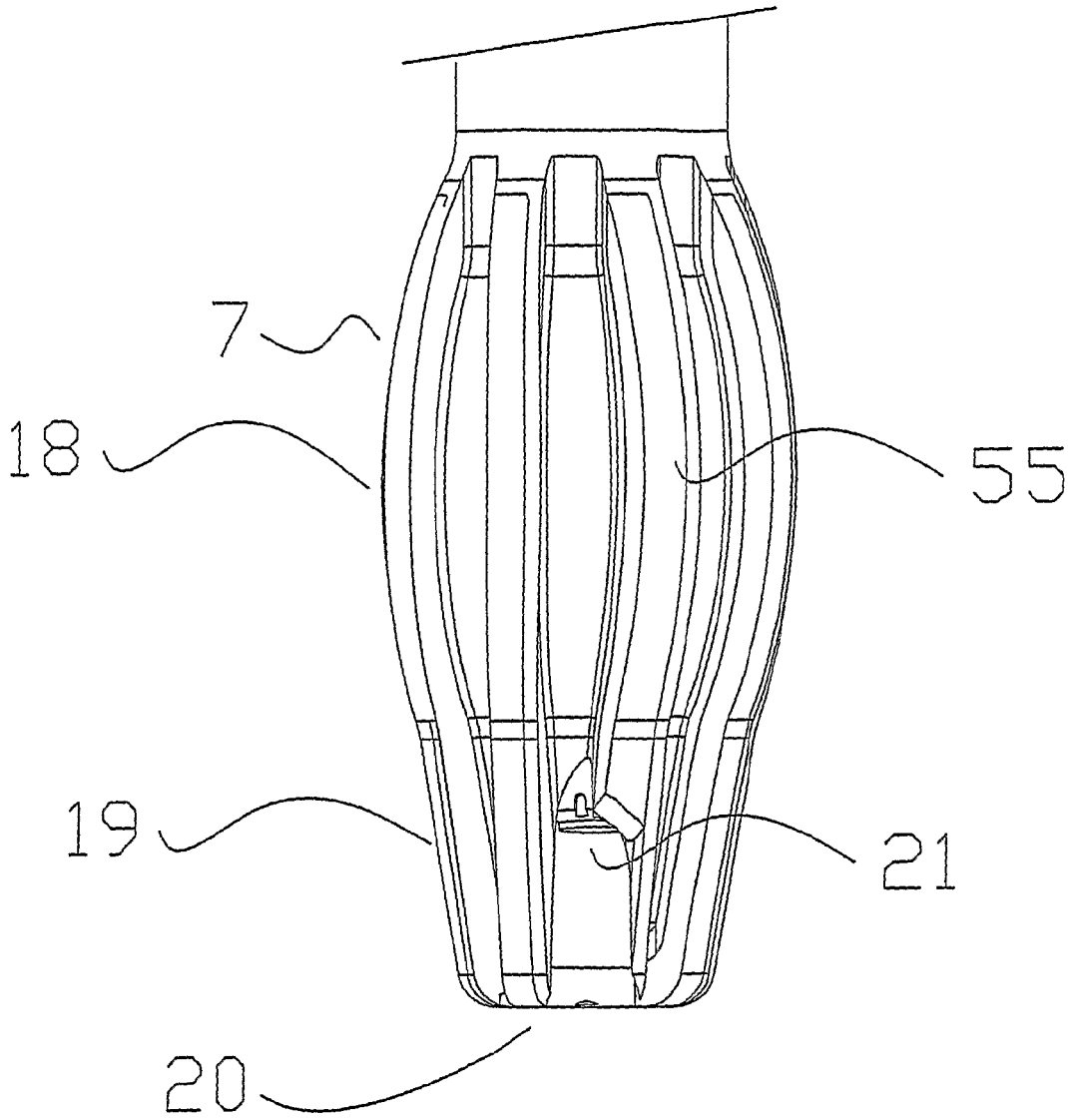
FIG. 11 illustrates a close up view of the mill head.

As assembled, the first mill 2 is connected to the top of the whipstock 6 by means of at least one kick out lug 4 and at least one releasable fastener 3, for example a shear bolt as shown in FIG. 2 whereby the mill is aligned with the kick out lug 4 via a locating hole 57, FIGS. 2, 4*a*, 10, on the mill 7 in the tapered profile 19, FIGS. 10 and 11 at the extreme top of the whipstock 6. The kick out lug 4 is positioned at the top of the whipstock 6, the specific location being determined by a measured offset distance from the top of the whipstock subject to mill diameter and casing bore to ensure the assembly can pass through the bore of the casing and mill through the wall of the casing accordingly. The location can be predetermined by aligning hole 9 in the top of the whipstock with any of the holes 10 in the kick out lug 4 FIG. 2, and FIG. 3, which provides axial displacement at the top of the whipstock 6, as described. The alignment holes may be through the back of the whipstock and blind in the kick out lug as shown, or drilled completely through the kick out lug. Alignment may be by use of a suitable dowel or other appropriate guide means. The kick out lug may be secured to the top of the whipstock by bolting, or welding, or braising, or even as an integral part of the whipstock.

Figure 12:
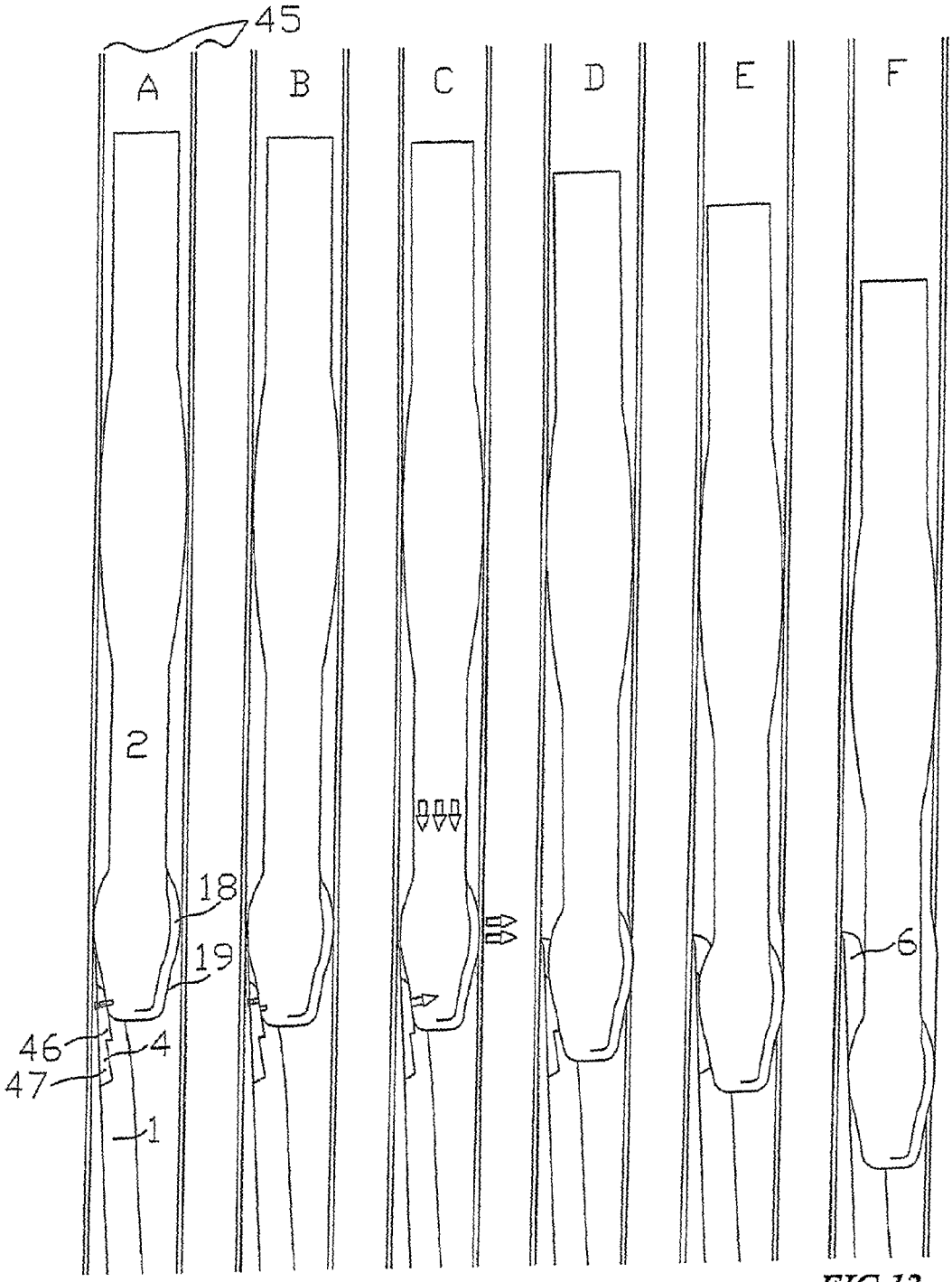
FIG. 12 illustrates cut out through the casing in sequence and the interaction between the mill and whipstock kick out lug.
Figure 13:
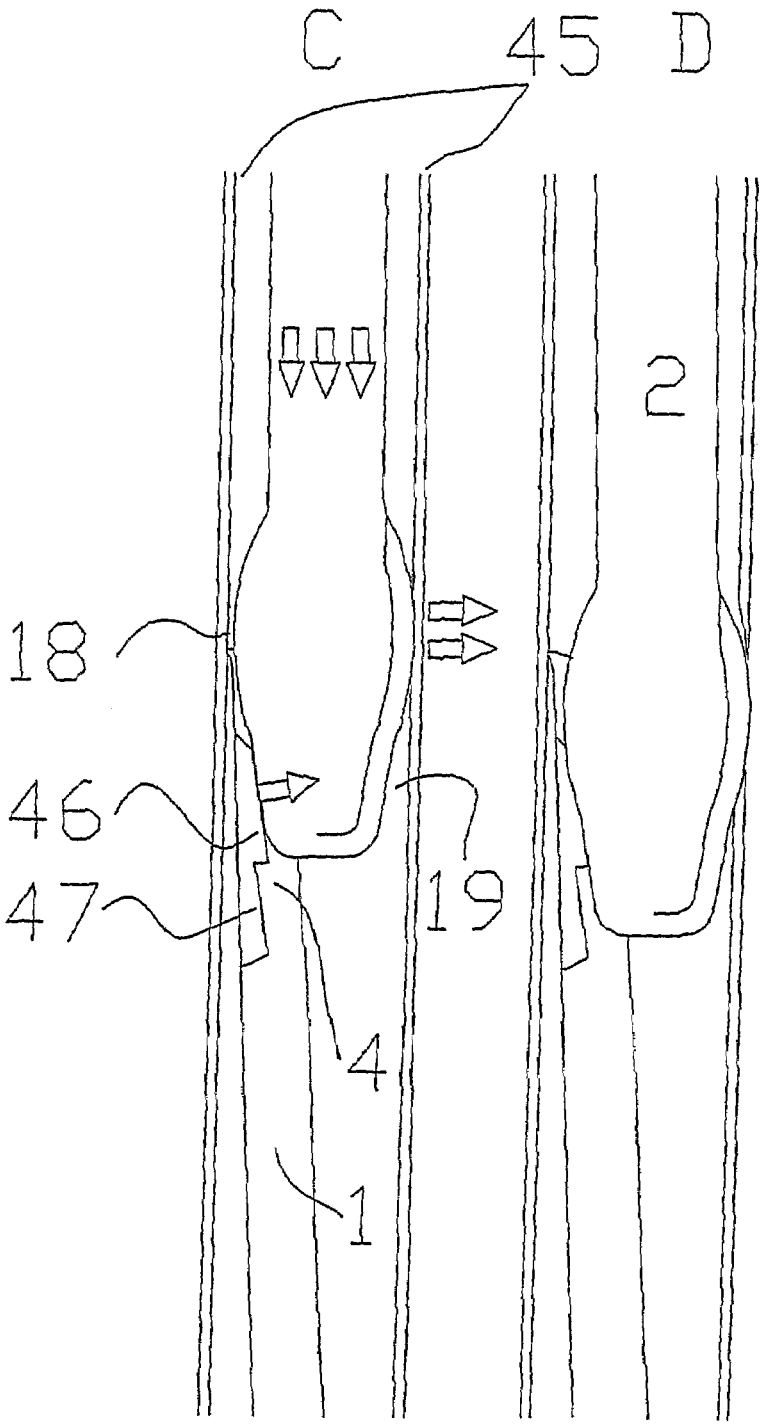
FIG. 13 illustrates a close up view of the initiation of the casing cut out from FIG. 12.

As shown in FIG. 2, and FIG. 3, the shear bolt 3 is inserted through a slot 11 in the back of the whipstock and engages a bore in the kick out lug 4 and mill head 7 respectively, such that the shear bolt head is fully encompassed in the kick out lug, such that it will be totally consumed when the milling assembly traverses and mills off the kick out lug. The sheared section remaining in the mill head is retained by conventional means such as loctite, or a nylok insert 5. This secures the mill head 7 to the top of the whipstock 6 via the kick out lug 4. The location of the bore in the mill head is significant, as the mill head is provided with a taper 19 matching the kick out lug tapers, 46, 47 as shown in FIG. 13, and as shown in FIG. 2, and FIG. 4, is attached to the uppermost tapering face 46, FIG. 12. The slot 11, FIG. 3, in the back of the whipstock allows for axial movement of the block without being constrained by a locating hole for the shear bolt 3. The mill 2 is now attached to the whipstock 1 and is used to convey the whipstock into the well bore casing. Referring now to FIG. 4, an alternative locating means is shown, whereby the shear bolt 22 attachment means may be located in a hole 57 in the mill head 7, for example by a thread, which is then inserted into the conical hole 56 in the top tapered face 46 of the kick out lug, and which may be secured by a long pin 23 inserted from the lower end of the kick out lug 4 as shown. The long pin 23, may be threaded at one end to secure it in the locating hole, ideally with a left hand thread, such that the milling action as the mill traverses the kick out lug in a clockwise (looking on the mill from above) direction, will not cause it to unscrew. Again, the purpose being to consume all attachment means through milling, or to recover them to surface. This alternative locating means can allow the mill 2 movement relative to the top of the whipstock through use of a conical hole 56 and a parallel bolt extension 58, FIG. 4*a*, with a domed face, and is therefore able to pivot within the well bore casing (not shown) to negotiate any deviation there through. Should orientation of the whipstock 1 be required, torque may be transmitted by the milling assembly 2, through the bolt and kick out lug to the whipstock top 6. The first mill 7 is formed with a multiplicity of blades 55, which extend across the face 20 of the mill in first a taper 19 before transitioning to an elliptical form and which extend along the side 18 of the mill head body 7 shown in FIG. 10, and FIG. 11. The shear bolt location, which is welded to or machined integral with the body of the mill head 7 is provided with a location hole 57, FIG. 4, whereby the strength of the section is sufficient to support the whipstock 1 and hinge connector 33 with anchor or packer (not shown), and to withstand an axial force in either direction (up or down relative to the whipstock top 6) to shear release the bolt 3 or 22, and to safely transport the assembly to the desired setting depth without premature release. It will be noted that the milling assembly 2, mill 7, 8, is full gauge and may remain so through the means of attachment to the whipstock 1 via the kick out lug 4. Other configurations of attaching the mill to the kick out lug may be provided, for example, a shear bolt may be inserted transversely through the taper 19 of the mill head 7 and secured in the normal manner using loctite, nylock inserts, and even circlips or snap rings.

Once at depth and the packer set, the mill may be released from the top of the whipstock, and milling commenced. It will be noted, that the mill location at the top of the whipstock allows for a full gauge milling assembly, as the mill is not sandwiched between the whipstock top and the casing. This allows a mill and whipstock combination of maximum diameter if desired, to pass through the casing inside diameter.

Figure 5:
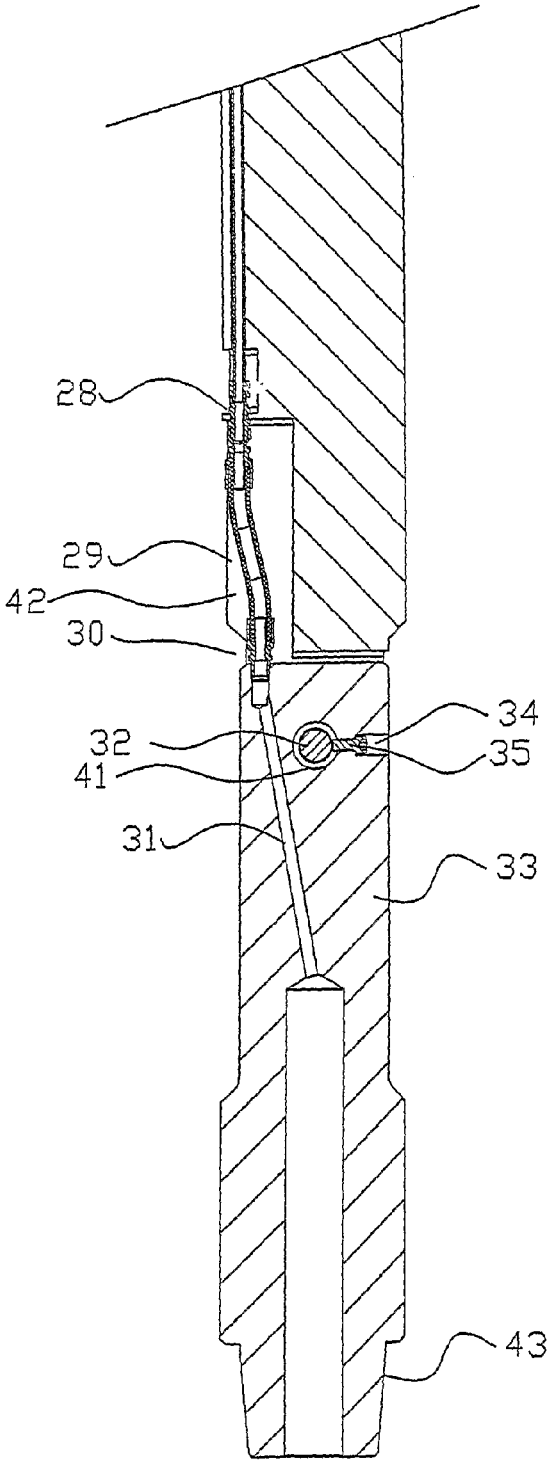
FIG. 5 illustrates the whipstock attachment means and hydraulic flow path to the hinge connector in a longitudinal axis cross section.
Figure 8:
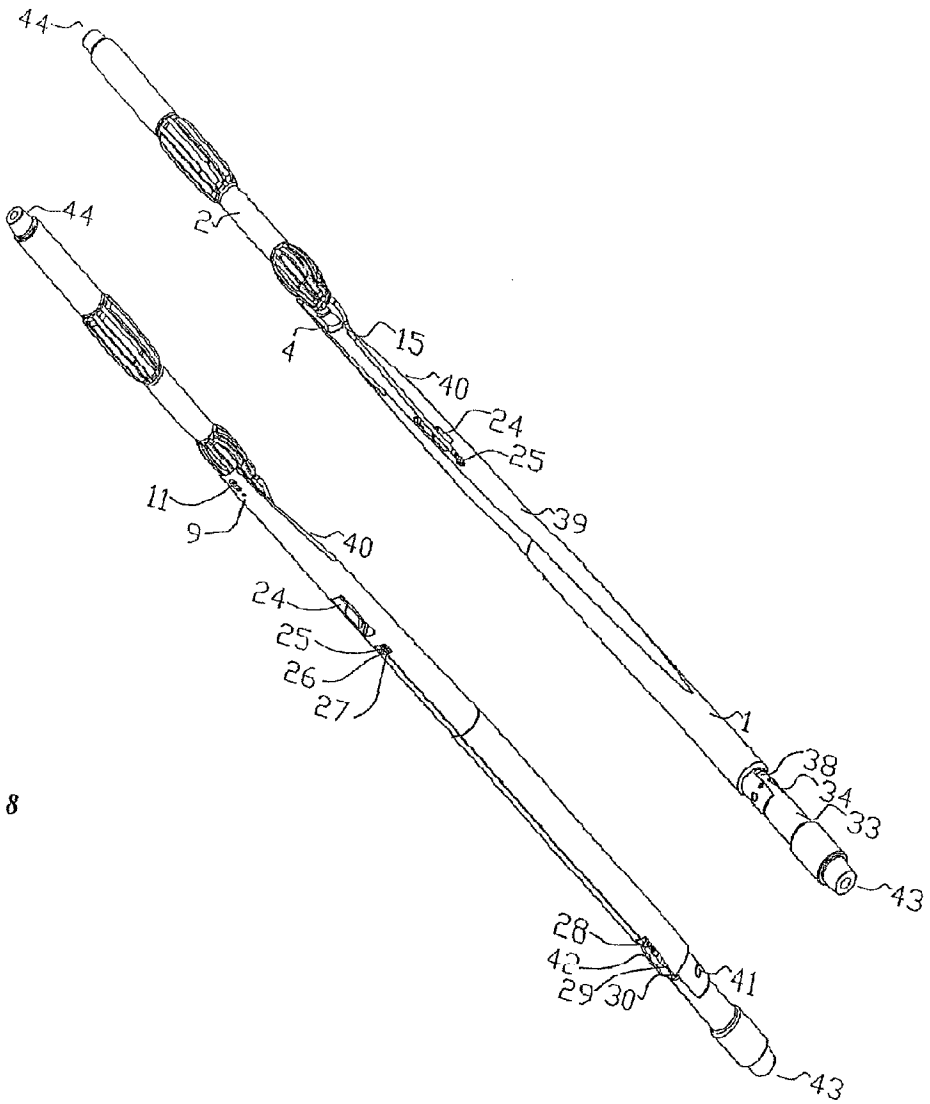
FIG. 8 illustrates the milling assembly attached in a hydraulic configuration to the whipstock and hinge connector in isometric views from above and below the whipstock.
Figure 9:
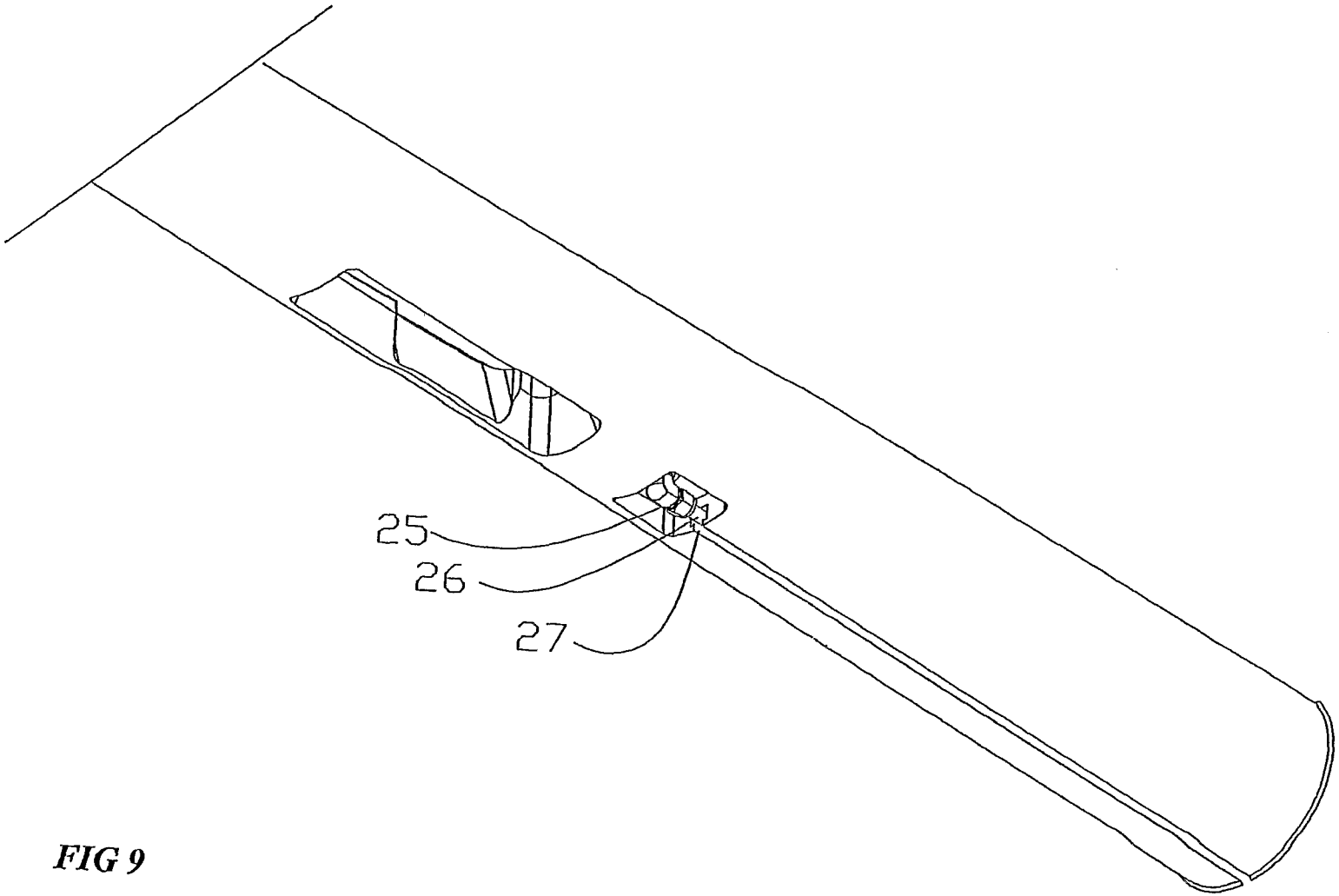
FIG. 9 illustrates a close up view of the arrangement to provide containment of the pipe work for the hydraulic flow path along the whipstock.

The anchor or packer is set in response to a fluid pressure generated in the system, for example at 1200 psi, when this pressure is reached, it can be increased to a pressure such as 2000 psi or 3000 psi, and sometimes there may be even higher setting pressures as part of the system deployment. The mill 2 communicates hydraulically with the anchor or packer through a hydraulic path in the whipstock 1, via a hydraulic fitting 14, sealed in the mill head with seals 13 and nozzle 12, via a sacrificial hydraulic pipe 15, FIG. 2. This pipe is connected to another pipe 26 which is installed in a T slot 27, FIG. 8 and FIG. 9, milled into the back of the whipstock 1, and is retained by virtue of the T slot shape, and connected to other pipe lengths 29 via connectors 25, 28, FIGS. 5, 8, 9. Any other suitable means of forming this hydraulic communication is suitable, for example by gun drilling a hole along the length of the whipstock 1. Referring to FIG. 5, the lower end of the whipstock is provided with a slot 42 to accommodate the movement of the hinge connector 33 with the express view to preventing the hose 29 from bulging out into contact with the casing when running the whipstock assembly in the hole. The hose is connected to the hinge connector tang 38, FIG. 7, by fitting 30, and to a bore 31 there through, FIG. 5. Connector 28 is a bulkhead type connector, and establishes a location for attaching pipe 26. The whipstock 1 is allowed to rotate a limited amount about the hinge pin 32, FIG. 6 relative to the hinge connector 33 without fracturing the pipe 29, FIG. 5. This hinging capability can be isolated by suitable means if it is not desirable in any particular application.

Immediately upon assembly of the system, and prior to running in hole, the anchor or packer, whipstock and milling assembly are filled with clean fluid up to and including the running tool, not shown, and the air bled out, before inserting the barrier. The assembly is then made up to the other necessary components to run in hole, such as flex joint, and bypass valve, followed by MWD (for example), and drill string to surface in the normal manner.

In use, the entire assembly is run in hole and the string is allowed to fill via the bypass valve. The purpose of this hydraulic arrangement is to provide a positive barrier, and then maximum circulation to and through the milling assembly for cooling of the cutting structure, as well as hole cleaning, whereby steel and formation cut by the mill is circulated to surface and out of the hole.

Figure 14:
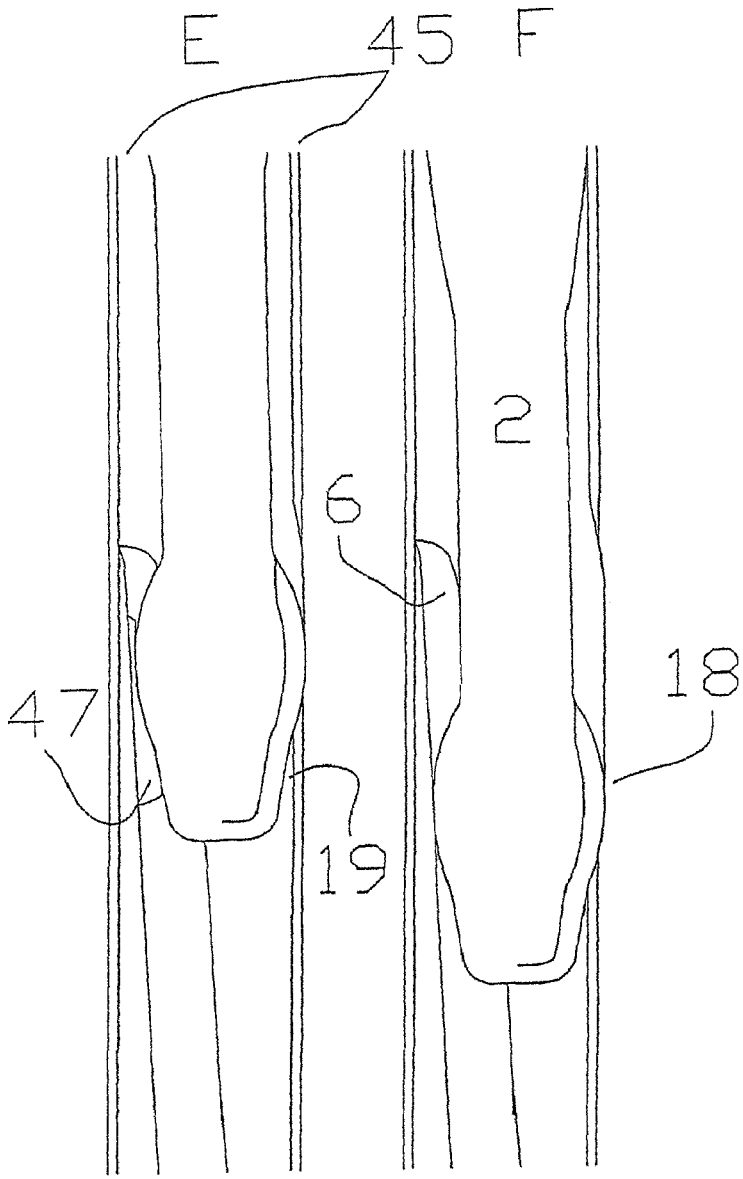
FIG. 14 illustrates a close up view of the continuation of the casing cut out from FIG. 12, and the mill off of the kick out lug.

The mill 2 is dressed with a wear resistant cutting structure, and the whipstock 1 is manufactured from a hardened material (alloy steel) in order to prevent or minimise any wear. Significantly, the kick out lug 4, may be manufactured from a harder material than the whipstock, such that it protects the whipstock during the initial mill cut out operation through the casing, FIG. 12, FIG. 13, and FIG. 14. This can allow the whipstock to be manufactured from a conventional lower alloy and softer steel, reducing equipment costs, especially as the alloying elements are now significantly more expensive than in previous years. In any case, the kick out lug 4 is sacrificial, and is designed to support the mill head 7, pushing it radially outwards through the casing 45 in response to weight or downward force on the milling assembly 2, view C, FIG. 12. Once the mill 2 is disconnected from the whipstock 1 and kick out lug 4, the milling is commenced. The mill 2 is rotated at the desired rotational speed, and lowered into contact with the top of the whipstock and kick out lug 4, view A, B and C. Whilst the kick out lug 4 may be of a single tapered design, as the mill progresses along it, the bearing area will reduce such that the mill is no longer supported, with the consequence that the mill may deflect into it and mill into the whipstock face during the critical phase of the cut out operation. Furthermore, extending the lug will cause contact of the mill mandrel with the inside of the casing bore which may trap the milling assembly, or at least cause polishing and heat checking of the mandrel through rotation and friction of the mandrel against the casing. This can result in cracking and failure of the milling assembly down hole, with subsequent loss of the whipstock and well bore. To avoid this problem, the kick out lug 4 is provided with at least two tapered faces, 46, 47. As the mill is kicked out radially through reaction with taper 19, it will cut through the casing 45, and as the mill progresses, view D, FIG. 12, the spherical shape of the mill starts to consume the top of the lug, increasing the bearing area. As the mill consumes the lug, the bearing area is reduced on the mating tapers, 19, 46, of the mill head 7 and kick out lug 4, whereby the support is provided entirely by the spherical face of the mill, however, because there may be a reaction from the formation resisting outward movement of the mill, the mill may have a tendency to fall back in toward the whipstock face. Furthermore, there is a reduction in bearing area from the tapered interacting faces. To combat this effect, the mill will pick up the second, lower tapered face 47 on the kick out lug 4, view E, and interact again with the taper 19 on the mill head, thus restoring the bearing area and support. This will assist the second, upper mill 8 in thinning out and cutting through the casing to extend and elongate the window cut out in the casing 45, view F, at which point the kick out lug 4 is totally consumed, but totally preserves the integrity of the whipstock top itself. At this point there will be no resistance to the milling assembly 2 from the casing 45.

As the whipstock 1 face 39 is of a conventional angle known in the industry, the mill will progress along it making contact with the inner wall of the casing, and will effect an opening which will extend as the mill 2 traverses the length of the whipstock 1. The shape of the mill blades 55 are of an ellipse combined with a specific taper 19 in a spiral disposition when viewed from the end of the mill, FIG. 10. The taper 19 may vary to match the tapers 46, 47 provided on the kick out lug 4, and will be in the order of 8°-15°. Once the mill 2 is on the whipstock 1, the major diameter 18 of the ellipse on the blades 55 will act as a gauge and support the mill 2, minimising any wear to the whipstock 1 face 39. Additional mills, are designed in a similar style to the mill 8, and perform the function of maintaining the window gauge and extending the top of the window up hole relative to the top of the whipstock 1 as required.

As an alternative, the mill 2 may be smaller than full gauge, and mounted in a similar manner as described to the top of the whipstock, whereby the mounting means is a kick out lug 4 or block or similar protrusion, of sufficient height and location spacing to accommodate the mill 7, and fixing means 3 or 22.

The same milling and whipstock assemblies may be utilised with mechanical or bottom set anchors, whereby the mill needs to be sheared down to ensure the anchor is set, furthermore, no hydraulic pipe work or barriers are necessary in this arrangement, such that circulation through the mill is immediately available. In this case, the mill 2 will circulate immediately through the hydraulic port 21, FIG. 11, and will be fitted with a protector sleeve or nozzle 12, to eliminate corrosion or circulation damage. The same orientation principles may be utilised, without the need for a bypass valve. In this embodiment, there is sufficient differential in the mill diameter and tapered faces 19 on the mill and 46 on the kick out lug at the top of the whipstock 6 to allow the necessary downward movement to shear the shear bolt 3 or 22 to disconnect from the whipstock. Milling can commence conventionally thereafter. As with the first whipstock embodiment, this whipstock is also retrievable.

Figure 6:
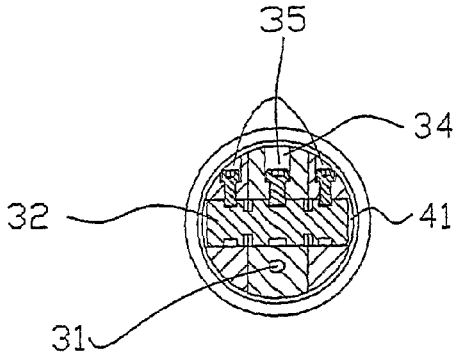
FIG. 6 illustrates a cross section through the hinge pin perpendicular to the longitudinal axis shown in FIG. 5.
Figure 7:
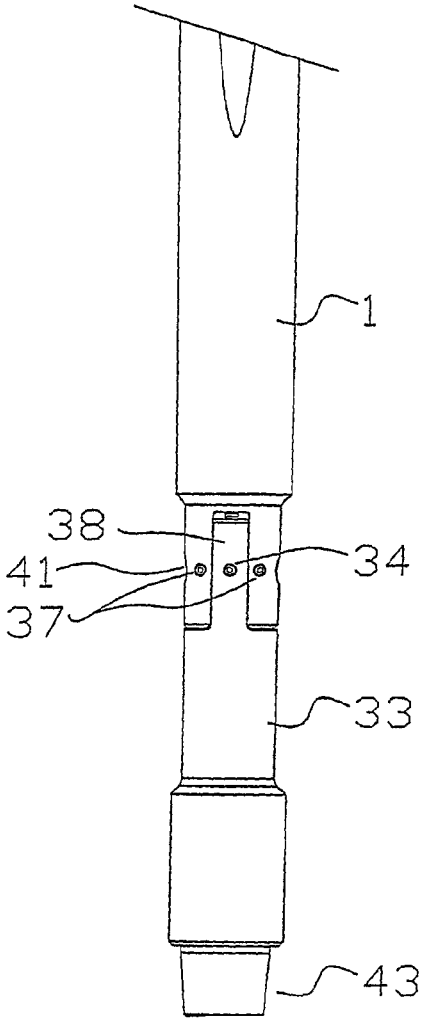
FIG. 7 illustrates the external arrangement of the whipstock attachment to the hinge connector.

Referring now to FIGS. 5 and 6, the whipstock 1 is attached to the hinge connector 33 by means of a hinge pin 32 which is inserted through holes 41 in the bottom end of the whipstock 3, and hole located in the tang 38 in the top of the hinge connector 33, FIG. 7. The hinge pin 32 is retained by a retaining means such as a bolt 35 disposed in countersunk holes 34, 37 in three locations, such that in the event the whipstock 1 and anchor or packer need to be recovered from the well bore, they can be recovered by shearing the hinge pin 32 preferentially. This will result in the anchor or packer being left in the hole and will require recovery on a further run in the hole with an overshot or similar fishing tool. The recovery of the whipstock 1 may be achieved in at least two ways, though not limited to these examples. By running a retrieving hook and engaging the hook slot 24, FIG. 8 in the whipstock face 39. The retrieving hook may be provided with circulation ports, which can be used to wash any debris out of the hook slot 24 prior to engaging the hook. Alternatively, a die collar may be rotated over the top of the whipstock 1, on the taper 40 to engage the whipstock. Once engaged the whipstock may be released form the hinge connector and recovered to surface.

Figure 15:
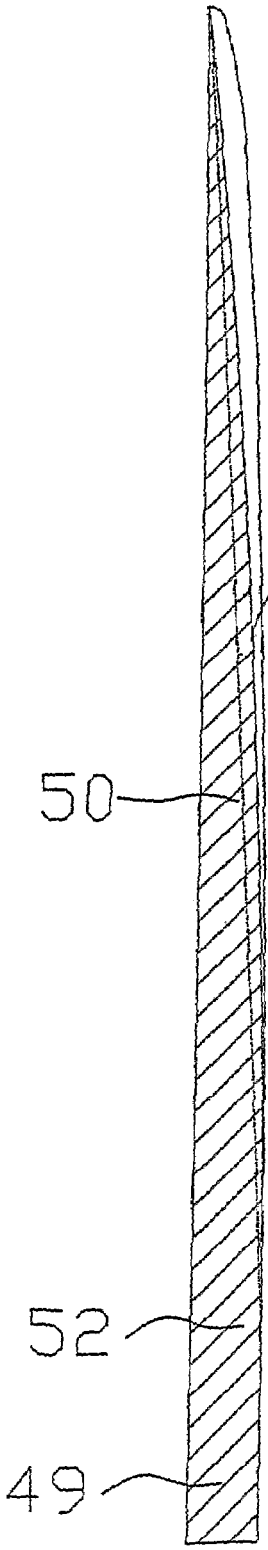
FIG. 15 illustrates whipstock face curvature extending in a curve directed out from the axis of the whipstock.
Figure 16:
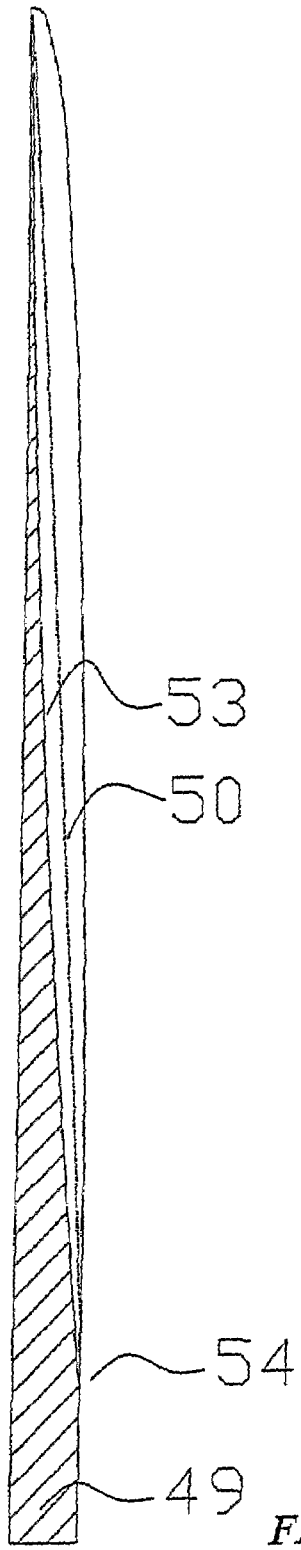
FIG. 16 illustrates whipstock face curvature extending in a curve directed in from the axis of the whipstock.

Whipstocks are conventionally provided with a tapering face to guide the milling or drilling assembly out of the casing into the formation. Subject to the DLS (Dog Leg Severity) requirements of the well, or field application with respect to Multilateral junction technology, it may be necessary to change the whipstock face angle, either reducing or increasing it as necessary. Conventional whipstocks may have a face angle close to 3°, and some whipstocks have multiple face angles ranging from parallel to the well axis to 15°, subject to the application, with a view to varying the DLS across the whipstock face. Referring now to FIGS. 15 and 16, the conventional 3° face angle is represented by the dashed line 50 on whipstock 49. FIG. 15 shows an outwardly curved face 51, which gives the mill an accelerated attack path relative to the casing and formation, such that more formation will be removed in the proximity of the whipstock opening a larger hole adjacent the whipstock. Conversely FIG. 16 shows an inwardly curved face 53, which gives the mill a lesser exposure to the formation, yet still allows removal of the casing (not shown) adjacent the whipstock top, thus preserving the mill. Comparing the relative window lengths, the outwardly curved face 51 will produce a shorter window profile and higher DLS, as evidenced by the run out 52 on the whipstock, whereas the inwardly curved face 53 will produce a longer window profile and lower DLS, as evidenced by the run out 54 on the whipstock. Due to the aggressive nature of departure profile of the whipstock shown in FIG. 15, it is likely that a limber single mill or short type milling assembly would be utilised to mill the window, which would terminate at the bottom of the whipstock, prior to whipstock substitution. It is part of the invention that the whipstocks in FIGS. 15 and 16 will be utilised with the kick out lug 4 as provided on a conventionally angled whipstock. The whipstocks provide a guide face which can give a very short window, or conversely very long, within the constraints of the mechanical ability of the milling assembly to withstand the loads exerted during a high DLS exit (very short window), however, the curved profile generally avoids rapid changes in a radial direction across the whipstock face.

Advantages for this type of whipstock profile may be derived by milling a window with a view to installing a device to seal the junction in the window opening, where formation will not obstruct the equipment that is deployed for this purpose. It is anticipated that it may be convenient to recover the whipstock and substitute it with a deflector, or whipstock of lower DLS to take advantage of the clearances offered, and even to extend the window below the original location. Alternatively, the reverse may apply, where the window is milled with a low DLS, and if a deflector device is required, the whipstock with the higher DLS or externally curved profile, is inserted to kick the next assembly out of the window.

Applications for a whipstock with a shallow, inwardly curved whipstock face, with a low DLS, are for example suited to milling a window for running what is known as a close tolerance liner or casing exit, whereby the liner outside diameter is almost as big as the window diameter milled, say 11¾" OD liner or casing versus 12¼" window diameter. The liner will also be heavy walled, whereby, it is less flexible, or stiffer, so it can not be so easily deflected as a thinner walled, smaller diameter liner or casing of say 9⅝" OD. Connections between lengths of liner or casing have limiting DLS values that they can pass through and remain gas tight, as per manufacturers' recommendations, so provision of a low DLS whipstock device is required to meet their criteria.

In preferred embodiments of the invention, the whipstock face has a transition portion, with the curvature of the whipstock face changing gradually over substantially the length of the transition portion. Advantageously, the transition portion comprises at least one-third of the length of the total whipstock face. Alternatively, the transition portion may be at least half of the length of the whipstock face. In other embodiments, the transition portion may be at least two-thirds of the length of the whipstock face. In yet further embodiments, the transition portion may be substantially the entire length of the whipstock face.

When used in this specification and claims, the terms "comprises" and "comprising" and variations thereof mean that the specified features, steps or integers are included. The terms are not to be interpreted to exclude the presence of other features, steps or components. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A whipstock having a longitudinal axis and comprising:

a tapered face surface, at least a part of which is continuously inclined with respect to the longitudinal axis, for guiding a milling head as the milling head passes from a top end to a bottom end of the inclined part of the face surface; and a deflection arrangement located between the top end and bottom end of the inclined part of the face surface and protruding from the inclined part of the face surface and having first and second deflection surfaces, at least a part of each of the deflection surfaces being raised above the inclined part of the face surface and each of the first and second deflection surfaces being acutely inclined relative to the face surface inclined at a greater angle with respect to the longitudinal axis than the inclined part of the face surface in the location of the deflection arrangement, wherein the first deflection surface is located closer to the top end of the inclined part of the face surface than the second deflection surface; and wherein a milling head passing along the whipstock tapered face surface will be deflected away from the inclined part of the face surface by the first and second deflection surfaces and return to the inclined part of the face surface after moving past the deflection arrangement.

2. A whipstock according to claim 1, wherein the deflection arrangement is joined to the face surface.

3. A whipstock according to claim 1, wherein the deflection arrangement is integral with the face surface.

4. A whipstock according to claim 1, wherein the first and second deflection surfaces are substantially parallel with each other, with the planes of the surfaces being offset from one another.

5. A whipstock according to claim 1, wherein each of the deflection surfaces has a top edge, being the edge nearest to the top end of the inclined part of the face surface, and a bottom edge, being the edge nearest to the bottom end of the inclined part of the face surface, and wherein the bottom edge of the first deflection surface is raised above the face surface by a greater amount than the top edge of the second deflection surface.

6. A whipstock according to claim 1, wherein the second deflection surface is provided substantially adjacent the first deflection surface.

7. A whipstock according to claim 1, wherein a space is provided between the first and second deflection surfaces.

8. A whipstock according to claim 1, wherein the deflection arrangement is provided as a single unit protruding from the face surface.

9. A whipstock according to claim 1, wherein the deflection arrangement is provided at or close to the top end of the face surface.

10. A whipstock according to claim 1, wherein at least the first and second deflection surfaces are formed from a material which is harder than that from which the face surface is formed.

11. A whipstock according to claim 1, comprising at least a third deflection surface, wherein: at least a part of the third deflection surface is raised above the inclined part of the face surface; the third deflection surface is inclined at a greater angle with respect to the longitudinal axis than the face surface in the region of the deflection arrangement; and the third deflection surface is located further from the top end of the face surface than the second deflection surface.

12. A whipstock according to claim 11, comprising at least a fourth deflection surface, wherein: at least a part of the fourth deflection surface is raised above the inclined part of the face surface; the fourth deflection surface is inclined at a greater angle with respect to the longitudinal axis than the face surface in the region of the deflection arrangement; and the fourth deflection surface is located further from the top end of the face surface than the third deflection surface.

13. The whipstock according to claim 1, wherein the inclination of the inclined part of the face surface with respect to the longitudinal axis is greater at a first region near the top end thereof than at a second region near the bottom end thereof, with the face being curved between the first region and the second region so as to be substantially continuous.

14. A whipstock according to claim 13, wherein the whipstock face has a transition portion between the first region and the second region, inclination of the whipstock face with respect to the longitudinal axis changing gradually over substantially the length of the transition portion, the transition portion being at least one-third of the length of the total whipstock face.

15. A whipstock according to claim 14, wherein the transition portion is at least one-half of the length of the total whipstock face.

16. A whipstock according to claim 14, wherein the transition portion is at least two-thirds of the length of the total whipstock face.

17. A whipstock according to claim 14, wherein the transition portion is substantially the entire length of the whipstock face.

18. A whipstock assembly comprising:

a whipstock according to claim 1; and a milling arrangement comprising a milling head, at least a part of the profile of the milling head being shaped so that, when the milling head is guided by the inclined part of the face surface of the whipstock during normal use thereof, the part of the profile is substantially parallel with the at least one of the deflection surfaces when the part of the profile meets the at least one of the deflection surfaces.

19. A whipstock assembly according to claim 18 wherein, when the milling head is guided by the inclined part of the face surface of the whipstock during normal use thereof, the part of the profile is substantially parallel with the first deflection surface when the part of the profile meets the first deflection surface and is substantially parallel with the second deflection surface when the part of the profile meets the second deflection surface.

20. A method of guiding a milling head to form a cutout in the casing of a bore, comprising the steps of:

providing a whipstock having a longitudinal axis and comprising: a tapered face surface, at least a part of which is continuously inclined with respect to the longitudinal axis, for guiding a milling head as the milling head passes from a top end to a bottom end of the inclined part of the face surface; and a deflection arrangement located between the top end and bottom end of the inclined part of the face surface and protruding from the inclined part of the face surface and having first and second deflection surfaces, each of which is inclined at a greater angle with respect to the longitudinal axis than the inclined part of the face surface in the region of the deflection arrangement, wherein the first deflection surface is located closer to the top end of the inclined part of the face surface than the second deflection surface, and wherein each of the deflection surfaces has a top edge, being the edge nearest to the top end of the inclined part of the face surface, and a bottom edge, being the edge nearest to the bottom end of the inclined part of the face surface, and wherein the bottom edge of the first deflection surface is raised above the inclined part of the face surface by a greater amount than the top edge of the second deflection surface;

locating the whipstock in the existing bore so that the top end thereof is uppermost;

providing a milling arrangement comprising a milling head, at least a part of the profile of the milling head being shaped so that, when the milling head is guided by the inclined part of the face surface of the whipstock during normal use thereof, the part of the profile is substantially parallel with the at least one of the deflection surfaces when the part of the profile meets the at least one of the deflection surfaces; and driving the milling assembly so that the milling head is guided by the inclined part of the face surface as the milling head passes from a top end to a bottom end of the face surface, and so that the milling head is deflected away from the inclined part of the face surface and towards the casing of the existing bore by the first deflection surface and deflected towards the casing of the existing bore again by the second deflection surface.

* * * * *